US012753574B2

(12) United States Patent
Tanaka et al.

(10) Patent No.: US 12,753,574 B2
(45) Date of Patent: Oct. 6, 2026

(54) WORK MACHINE AND METHOD FOR CONTROLLING WORK MACHINE

(71) Applicant: KOMATSU LTD., Tokyo (JP)

(72) Inventors: Kenichiro Tanaka, Tokyo (JP); Yuichi Nakano, Tokyo (JP)

(73) Assignee: KOMATSU LTD., Tokyo (JP)

( * ) Notice: Subject to any disclaimer, the term of this patent is extended or adjusted under 35 U.S.C. 154(b) by 385 days.

(21) Appl. No.: 18/279,683

(22) PCT Filed: Apr. 25, 2022

(86) PCT No.: PCT/JP2022/018696
§ 371 (c)(1),
(2) Date: Sep. 1, 2023

(87) PCT Pub. No.: WO2022/255001
PCT Pub. Date: Dec. 8, 2022

(65) Prior Publication Data

US 2024/0133152 A1 Apr. 25, 2024
US 2024/0229414 A9 Jul. 11, 2024

(30) Foreign Application Priority Data

May 31, 2021 (JP) ..... 2021-091617

(51) Int. Cl.
*E02F 3/08* (2006.01)
*E02F 3/76* (2006.01)
(Continued)

(52) U.S. Cl.
CPC ..... *E02F 3/844* (2013.01); *E02F 3/7618* (2013.01); *E02F 9/02* (2013.01); *E02F 9/2203* (2013.01); *E02F 9/2285* (2013.01)

(58) Field of Classification Search
CPC ..... E02F 3/844; E02F 3/7618; E02F 3/432; E02F 3/845; E02F 9/02; E02F 9/2203; E02F 9/2285
See application file for complete search history.

(56) References Cited

U.S. PATENT DOCUMENTS 5,620,053 A * 4/1997 Kamikawa ..... E02F 3/7618 172/4
5,950,141 A * 9/1999 Yamamoto ..... E02F 9/2029 702/41
(Continued)

FOREIGN PATENT DOCUMENTS

CN 1179194 A 4/1998
JP 48-18001 Y 5/1973
(Continued)

OTHER PUBLICATIONS

WO2022255064A1 translation (Year: 2025).*
(Continued)

*Primary Examiner* — Thomas Ingram
*Assistant Examiner* — Ashutosh Pande
(74) *Attorney, Agent, or Firm* — Spencer Fane LLP

(57) ABSTRACT

A work machine includes a vehicle body, a blade supported so as to be rotatable about a pitch axis with respect to the vehicle body, a pitch actuator connected to the blade, a first sensor, and a controller. The pitch actuator causes the blade to perform a pitch motion about the pitch axis in a forward tilt direction and a backward tilt direction. The first sensor detects a first parameter relating to a penetration force of a blade tip of the blade in a downward direction. The controller determines whether the penetration force is insufficient based on the first parameter, and controls the pitch
(Continued)

actuator to cause the blade to perform the pitch motion in the forward tilt direction upon determining that the penetration force is insufficient.

10 Claims, 8 Drawing Sheets

(51) Int. Cl.

| | |
|---|---|
| ***E02F 3/84*** | (2006.01) |
| ***E02F 9/02*** | (2006.01) |
| ***E02F 9/22*** | (2006.01) |

(56) References Cited

U.S. PATENT DOCUMENTS

| | | | | |
|---|---|---|---|---|
| 9,551,130 | B2 * | 1/2017 | Hendron | E02F 3/7631 |
| 2006/0070746 | A1 * | 4/2006 | Lumpkins | E02F 3/844 172/2 |
| 2013/0000930 | A1 * | 1/2013 | Shintani | E02F 9/2228 701/50 |
| 2013/0037287 | A1 * | 2/2013 | Hall | E02F 3/7618 172/701.1 |
| 2014/0345889 | A1 * | 11/2014 | Nakata | E02F 3/847 172/1 |
| 2020/0157772 | A1 * | 5/2020 | Ninomiya | E02F 9/2041 |
| 2020/0173141 | A1 * | 6/2020 | Gentle | E02F 3/765 |
| 2021/0025127 | A1 * | 1/2021 | Uemura | E02F 3/7613 |
| 2021/0216075 | A1 * | 7/2021 | Takaoka | G05D 1/0274 |
| 2021/0254313 | A1 * | 8/2021 | Uemura | E02F 3/7618 |
| 2022/0064906 | A1 * | 3/2022 | Uemura | E02F 9/2296 |
| 2022/0195693 | A1 * | 6/2022 | Kalantar | E02F 3/841 |
| 2023/0220650 | A1 * | 7/2023 | Kadono | E02F 9/225 172/4.5 |
| 2024/0150996 | A1 * | 5/2024 | Tanaka | E02F 9/22 |
| 2024/0352706 | A1 * | 10/2024 | Sonoda | E02F 9/265 |

FOREIGN PATENT DOCUMENTS

| | | | | |
|---|---|---|---|---|
| JP | S63-108456 | U | 7/1988 | |
| JP | S63-210315 | A | 9/1988 | |
| JP | 7-252859 | A | 10/1995 | |
| JP | 9-209393 | A | 8/1997 | |
| JP | H09-209394 | A | 8/1997 | |
| JP | 2014-185754 | A | 10/2014 | |
| WO | WO-2022255064 | A1 * | 12/2022 | E02F 9/22 |

OTHER PUBLICATIONS

First Office Action received for Chinese Application No. 202280018275.0, issued on Jul. 9, 2025, 8 pages.

Notice of Reasons for Refusal received for JP Application No. 2021-091617, mailed on Dec. 2, 2025, 4 pages.

The International Search Report for the corresponding international application No. PCT/JP2022/018696, issued on Jul. 19, 2022.

* cited by examiner

WORK MACHINE AND METHOD FOR CONTROLLING WORK MACHINE

CROSS-REFERENCE TO RELATED APPLICATIONS

This application is a U.S. National stage application of International Application No. PCT/JP2022/018696, filed on Apr. 25, 2022. This U.S. National stage application claims priority under 35 U.S.C. § 119(a) to Japanese Patent Application No. 2021-091617, filed in Japan on May 31, 2021, the entire contents of which are hereby incorporated herein by reference.

BACKGROUND

Field of the Invention

The present invention relates to a work machine and a method for controlling a work machine.

Background Information

In some work machines, a pitch angle of a blade can be adjusted according to an operation by an operator. For example, a work machine in Japanese Unexamined Patent Publication No. H07-252859 is provided with an operating lever for adjusting the pitch angle of the blade. The operating lever is provided with a switch. Upon the operating lever being tilted to the right with the switch on, a hydraulic cylinder is controlled so that the blade is tilted forward (pitch dump). Upon the operating lever being tilted to the left with the switch on, the hydraulic cylinder is controlled so that the blade is tilted backward (pitch back).

SUMMARY

The pitch angle of the blade affects the work efficiency in digging work, leveling work, or the like. An appropriate pitch angle of the blade differs depending on the type of work. For example, when the pitch angle is small, that is, when the blade is tilted backward, the digging resistance is small and the digging performance is desirable, but the penetration force of the blade in the downward direction is small. Therefore, in a case where the pitch angle is smaller than an appropriate value during the work with low load, the front portions of crawler belts of the work machine may be lifted up. This reduces the work efficiency.

Therefore, it is desirable to appropriately adjust the pitch angle of the blade according to the work load. However, it is not easy for even a skilled operator to manually select an appropriate pitch angle accurately according to the work load. An object of the present disclosure is to make it possible to easily and appropriately adjust a pitch angle of a blade in a work machine according to a work load.

A work machine according to a first aspect of the present disclosure is a work machine including a vehicle body, a blade, a pitch actuator, a first sensor, and a controller. The blade is supported so as to be rotatable about a pitch axis with respect to the vehicle body. The pitch actuator is connected to the blade and causes the blade to perform a pitch motion about the pitch axis in a forward tilt direction and a backward tilt direction. The first sensor detects a first parameter. The first parameter relates to a penetration force of a blade tip of the blade in a downward direction. The controller determines whether the penetration force is insufficient based on the first parameter. The controller controls the pitch actuator to cause the blade to perform the pitch motion in the forward tilt direction upon determining that the penetration force is insufficient.

A method according to a second aspect of the present disclosure is a method for controlling a work machine. The work machine includes a vehicle body, a blade, and a pitch actuator. The blade is supported so as to be rotatable about a pitch axis with respect to the vehicle body. The pitch actuator is connected to the blade and causes the blade to perform a pitch motion about the pitch axis in a forward tilt direction and a backward tilt direction. The method includes detecting a first parameter relating to a penetration force of a blade tip of the blade in a downward direction, determining whether the penetration force is insufficient based on the first parameter, and controlling the pitch actuator to cause the blade to perform the pitch motion in the forward tilt direction upon determining that the penetration force is insufficient.

According to the present disclosure, the pitch angle of the blade can be easily and appropriately adjusted in the work machine according to the work load.

DETAILED DESCRIPTION OF EMBODIMENT(S)

Figure 1:
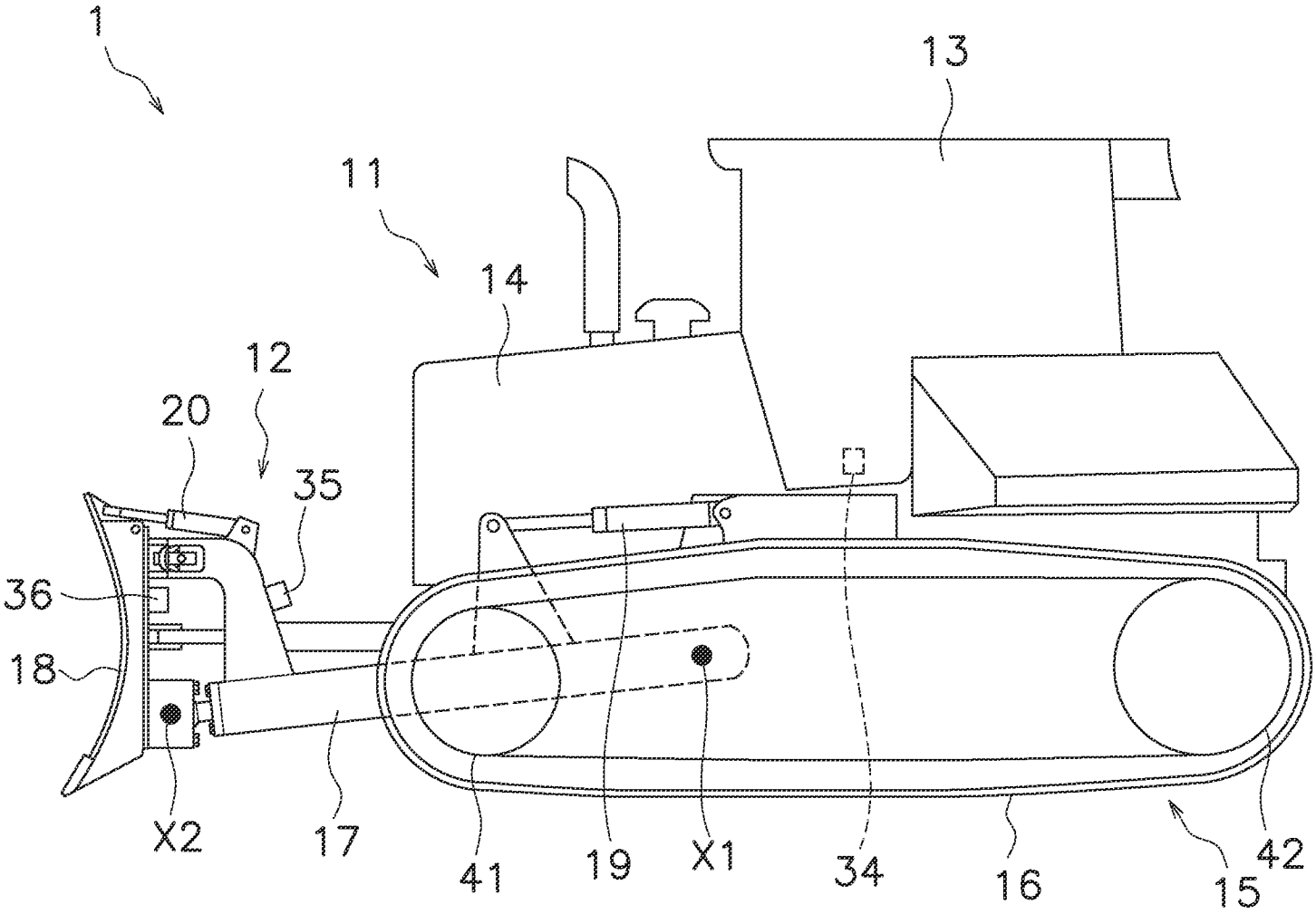
FIG. 1 is a side view of a work machine according to an embodiment.

A work machine according to an embodiment will be described below with reference to the drawings. FIG. 1 is a side view of a work machine 1 according to the embodiment. The work machine 1 according to the present embodiment is a bulldozer. The work machine 1 includes a vehicle body 11 and a work implement 12.

The vehicle body 11 includes an operating cabin 13, an engine compartment 14, and a travel device 15. An operator's seat that is not illustrated is disposed in the operating cabin 13. The engine compartment 14 is disposed in front of the operating cabin 13. The travel device 15 is provided at a lower portion of the vehicle body 11. The travel device 15 includes front wheels 41, rear wheels 42, and crawler belts 16. Only the left crawler belt 16 is illustrated in FIG. 1. The front wheels 41 are disposed in front of the rear wheels 42. The crawler belts 16 are wound around the front wheels 41 and the rear wheels 42. The work machine 1 travels due to the rotation of the crawler belts 16.

The work implement 12 is attached to the vehicle body 11. The work implement 12 includes a lift frame 17, a blade 18, a lift actuator 19, and a pitch actuator 20. The lift frame 17 is supported so as to be rotatable about a lift axis X1 with respect to the vehicle body 11. The lift axis X1 extends in a lateral direction of the vehicle body 11. The lift frame 17 rotates about the lift axis X1, thereby performing a lift motion up and down.

The blade 18 is disposed in front of the vehicle body 11. The blade 18 is supported so as to be rotatable about a pitch axis X2 with respect to the lift frame 17. The pitch axis X2 extends in the lateral direction of the vehicle body 11. The blade 18 rotates about the pitch axis X2, thereby performing a pitch motion in a forward tilt direction and a backward tilt direction. The blade 18 moves up and down as the lift frame 17 moves up and down.

The lift actuator 19 is coupled to the vehicle body 11 and the lift frame 17. The lift actuator 19 is a hydraulic cylinder. Due to the extension and contraction of the lift actuator 19, the lift frame 17 performs the lift motion up and down. The lift actuator 19 contracts, thereby causing the blade 18 to be raised. The lift actuator extends, thereby causing the blade 18 to be lowered.

The pitch actuator 20 is coupled to the lift frame 17 and the blade 18. The pitch actuator 20 is a hydraulic cylinder. Due to the extension and contraction of the pitch actuator 20, the blade 18 performs the pitch motion forward and backward. A portion of the blade 18, for example, its upper end moves forward and backward, thereby causing the blade 18 to perform the pitch motion about the pitch axis X2. The pitch actuator 20 extends, thereby causing the blade 18 to be tilted forward. The pitch actuator 20 contracts, thereby causing the blade 18 to be tilted backward.

Figure 2:
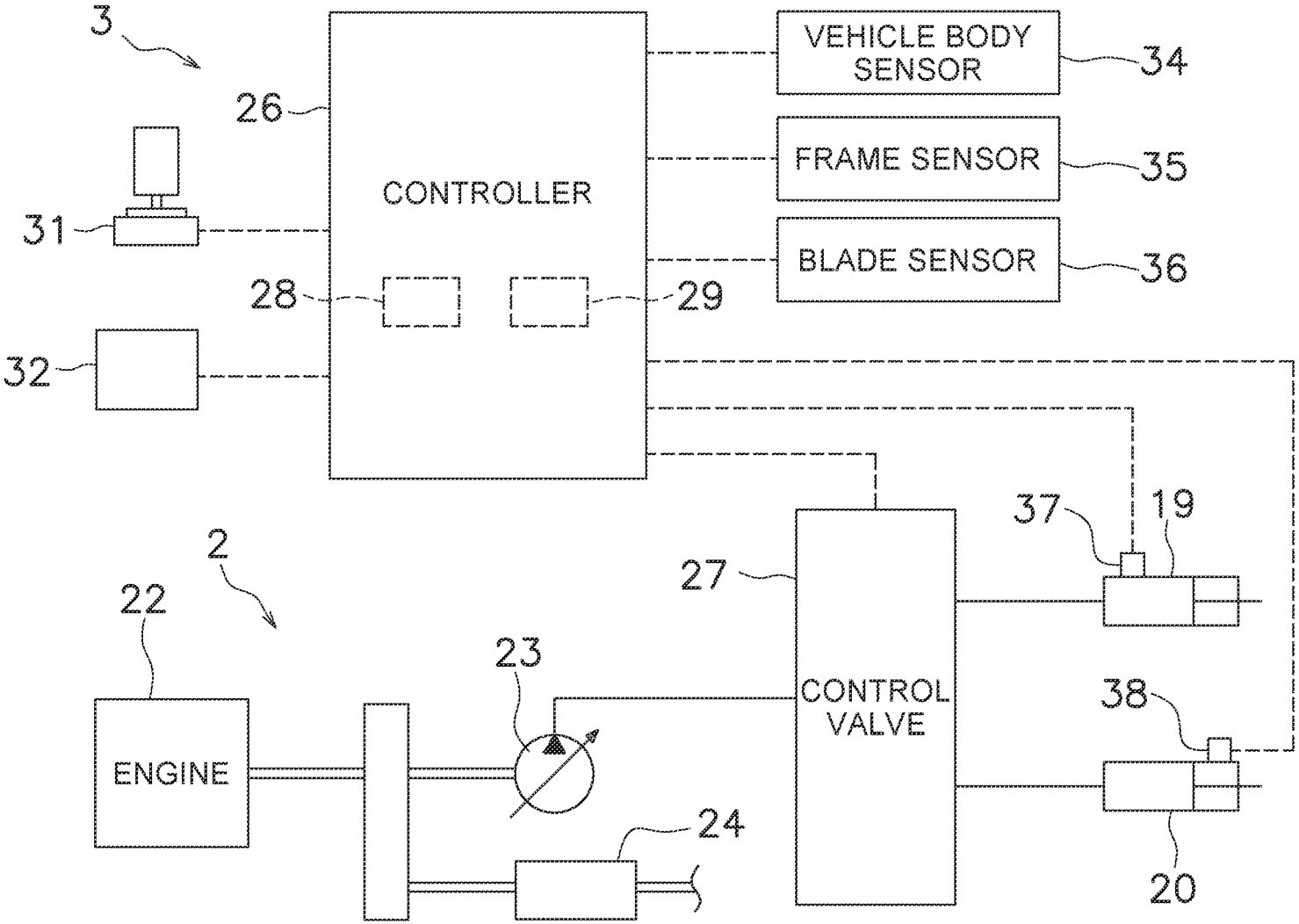
FIG. 2 is a block diagram illustrating a configuration of a drive system and a control system of the work machine.

FIG. 2 is a block diagram illustrating a configuration of a drive system 2 and a control system 3 of the work machine 1. As illustrated in FIG. 2, the drive system 2 includes an engine 22, a hydraulic pump 23 and a power transmission device 24. The hydraulic pump 23 is driven by the engine 22 to discharge hydraulic fluid. The hydraulic fluid discharged from the hydraulic pump 23 is supplied to the lift actuator 19 and the pitch actuator 20. Although one hydraulic pump is illustrated in FIG. 2, a plurality of hydraulic pumps may be provided.

The power transmission device 24 transmits driving force of the engine 22 to the travel device 15. The power transmission device 24 may be a hydro static transmission (HST), for example. Alternatively, the power transmission device 24 may be, for example, a transmission having a torque converter or a plurality of transmission gears.

The control system 3 includes a controller 26 and a control valve 27. The controller 26 is programmed to control the work machine 1 based on acquired data. The controller 26 includes a storage device 28 and a processor 29. The processor 29 includes a CPU, for example. The storage device 28 includes a memory and an auxiliary storage device, for example. The storage device 28 may be a RAM or a ROM, for example. The storage device 28 may be a semiconductor memory, a hard disk, or the like. The storage device 28 is an example of a non-transitory computer-readable recording medium. The storage device 28 stores computer instructions that are executable by the processor 29 and for controlling the work machine 1.

The control valve 27 is a proportional control valve and is controlled by a command signal from the controller 26. The control valve 27 is disposed between the hydraulic pump 23 and a hydraulic actuator such as the lift actuator 19 and the pitch actuator 20. The control valve 27 controls the flow rate of the hydraulic fluid supplied from the hydraulic pump 23 to the lift actuator 19. The control valve 27 controls the flow rate of the hydraulic fluid supplied from the hydraulic pump 23 to the pitch actuator 20. The control valve 27 may be a pressure proportional control valve. Alternatively, the control valve 27 may be an electromagnetic proportional control valve.

The control system 3 includes an operating device 31 and an input device 32. The operating device 31 includes a lever, for example. Alternatively, the operating device 31 may include a pedal or a switch. An operator can manually operate the travel of the work machine 1 and the motion of the work implement 12 using the operating device 31. The operating device 31 outputs an operation signal indicative of an operation of the operating device 31. The controller 26 receives the operation signal from the operating device 31.

The operating device 31 is configured to operate the lift motion of the blade 18. Specifically, the operating device 31 is configured to operate a raising operation and a lowering operation of the blade 18. When the operator performs the raising operation on the operating device 31, the controller 26 controls the lift actuator 19 so that the blade 18 is raised. When the operator performs the lowering operation on the operating device 31, the controller 26 controls the lift actuator 19 so that the blade 18 is lowered.

Figure 3:
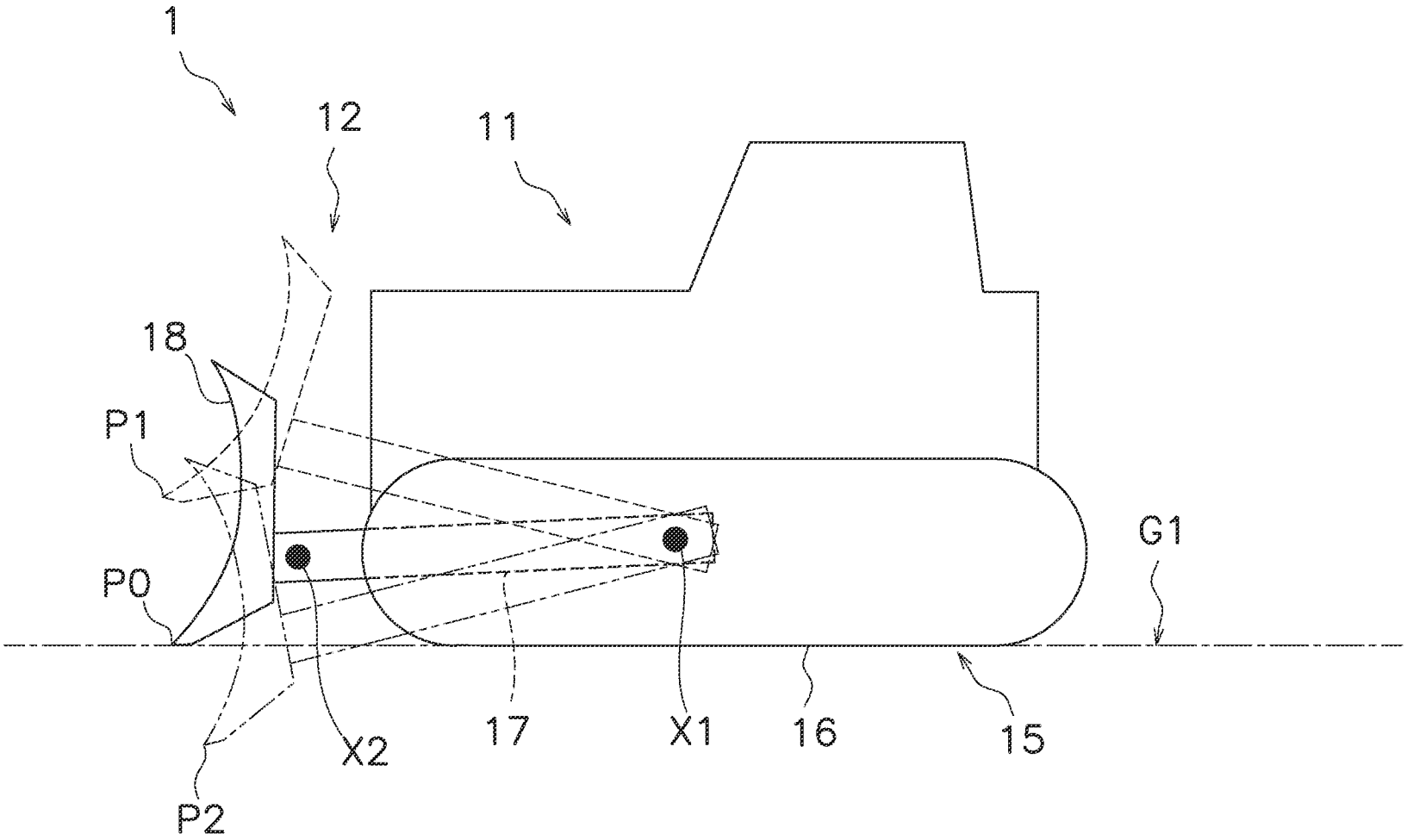
FIG. 3 is a schematic view illustrating a lift motion of a blade.

FIG. 3 is a schematic view illustrating the lift motion of the work machine 1. In FIG. 3, P1 indicates the highest position of a blade tip P0 of the blade 18. P2 indicates the lowest position of the blade tip P0 of the blade 18. The work machine 1 can cause the blade 18 to perform the lift motion between the highest position P1 and the lowest position P2.

The operating device 31 is configured to operate the pitch motion of the blade 18. Specifically, the operating device 31 is configured to operate a forward tilt operation and a backward tilt operation of the blade 18. When the operator performs the forward tilt operation on the operating device 31, the controller 26 controls the pitch actuator 20 so that the blade 18 is tilted forward. When the operator performs the backward tilt operation on the operating device 31, the controller 26 controls the pitch actuator 20 so that the blade 18 is tilted backward.

Figure 4:
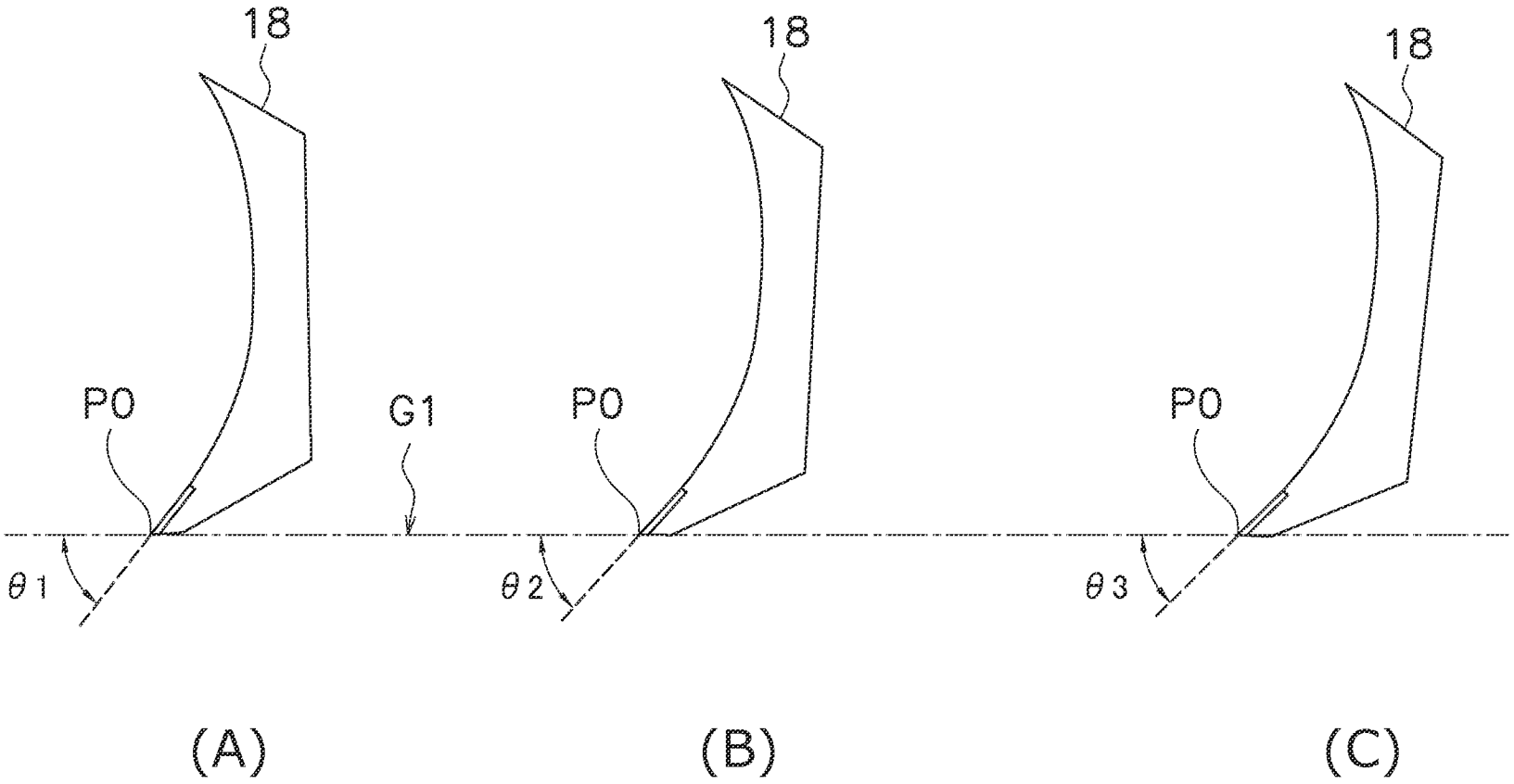
FIG. 4A, FIG. 4B and FIG. 4C are views illustrating pitch angles of the blade.

FIGS. 4A to 4C are views illustrating pitch angles of the blade 18. As illustrated in FIGS. 4A to 4C, pitch angles $\theta 1$ to $\theta 3$ of the blade 18 are the angles between the blade tip P0 of the blade 18 and a ground contact surface G1 of the crawler belts 16. FIG. 4B illustrates a pitch angle $\theta 2$ of the blade 18 in a normal state. FIG. 4A illustrates a pitch angle $\theta 1$ of the blade 18 tilted forward in comparison with the normal state. FIG. 4C illustrates a pitch angle $\theta 3$ of the blade 18 tilted backward in comparison with the normal state. The pitch angle increases as the blade 18 is tilted forward. The pitch angle decreases as the blade 18 is tilted backward. That is, the following formula $\theta 1 > \theta 2 > \theta 3$ is satisfied.

The operating device 31 may be a hydraulic pilot type device. For example, the operating device 31 may output pilot hydraulic pressure according to the operation of the operating device 31. The control valve 27 is controlled by the pilot hydraulic pressure from the operating device 31, whereby the lift actuator 19 or the pitch actuator 20 may be controlled. The controller 26 may receive a signal indicative of the pilot hydraulic pressure as the operation signal.

The input device 32 includes a touch screen, for example. The input device 32 may include another device such as a switch. The operator can set a control mode of the pitch angle of the blade 18 by the controller 26 using the operating device 31. The control mode of the pitch angle of the blade 18 will be described later in detail.

As illustrated in FIG. 2, the control system 3 includes a vehicle body sensor 34, a frame sensor 35, and a blade sensor 36. The vehicle body sensor 34 is attached to the vehicle body 11. The vehicle body sensor 34 detects a posture of the vehicle body 11. The frame sensor 35 is attached to the lift frame 17. The frame sensor 35 detects a posture of the lift frame 17. The blade sensor 36 is attached to the blade 18. The blade sensor 36 detects a posture of the blade 18.

The vehicle body sensor 34, the frame sensor 35, and the blade sensor 36 are inertial measurement units (IMU). However, the frame sensor 35 and the blade sensor 36 are not limited to the IMU and may be another sensor such as an angle sensor, a cylinder stroke sensor, or the like.

The vehicle body sensor 34 detects an angle in the front-back direction of the vehicle body 11 with respect to the horizontal direction (vehicle pitch angle). The frame sensor 35 detects a rotation angle of the lift frame 17. The blade sensor 36 detects the pitch angle of the blade 18. The vehicle body sensor 34, the frame sensor 35, and the blade sensor 36 output detection signals indicative of the angles detected by the respective sensors.

The control system 3 includes a first pressure sensor 37 and a second pressure sensor 38. The first pressure sensor 37 detects bottom pressure of the lift actuator 19. The bottom pressure of the lift actuator 19 is the hydraulic pressure of hydraulic fluid that is compressed when the lift actuator 19 contracts. The second pressure sensor 38 detects head pressure of the pitch actuator 20. The head pressure of the pitch actuator 20 is the hydraulic pressure of hydraulic fluid that is compressed when the pitch actuator 20 extends.

The controller 26 receives a first detection signal indicative of the bottom pressure of the lift actuator 19 from the first pressure sensor 37. The controller 26 receives a second detection signal indicative of the head pressure of the pitch actuator 20 from the second pressure sensor 38.

Next, the control mode of the pitch angle of the blade 18 will be explained. The control mode of the pitch angle of the blade 18 includes an automatic mode and a manual mode. The controller 26 switches between the automatic mode and the manual mode according to the operation of the input device 32. The operator can select the automatic mode or the manual mode by operating the input device 32.

In the automatic mode, the controller 26 controls the pitch angle of the blade 18 based on the first detection signal and the second detection signal. The controller 26 executes the automatic control of the pitch angle when a predetermined execution condition is satisfied. The predetermined execution condition includes a first condition and a second condition. The first condition is that the bottom pressure of the lift actuator 19 is greater than or equal to a first threshold. The second condition is that the head pressure of the pitch actuator 20 is less than or equal to a second threshold.

Figure 5:
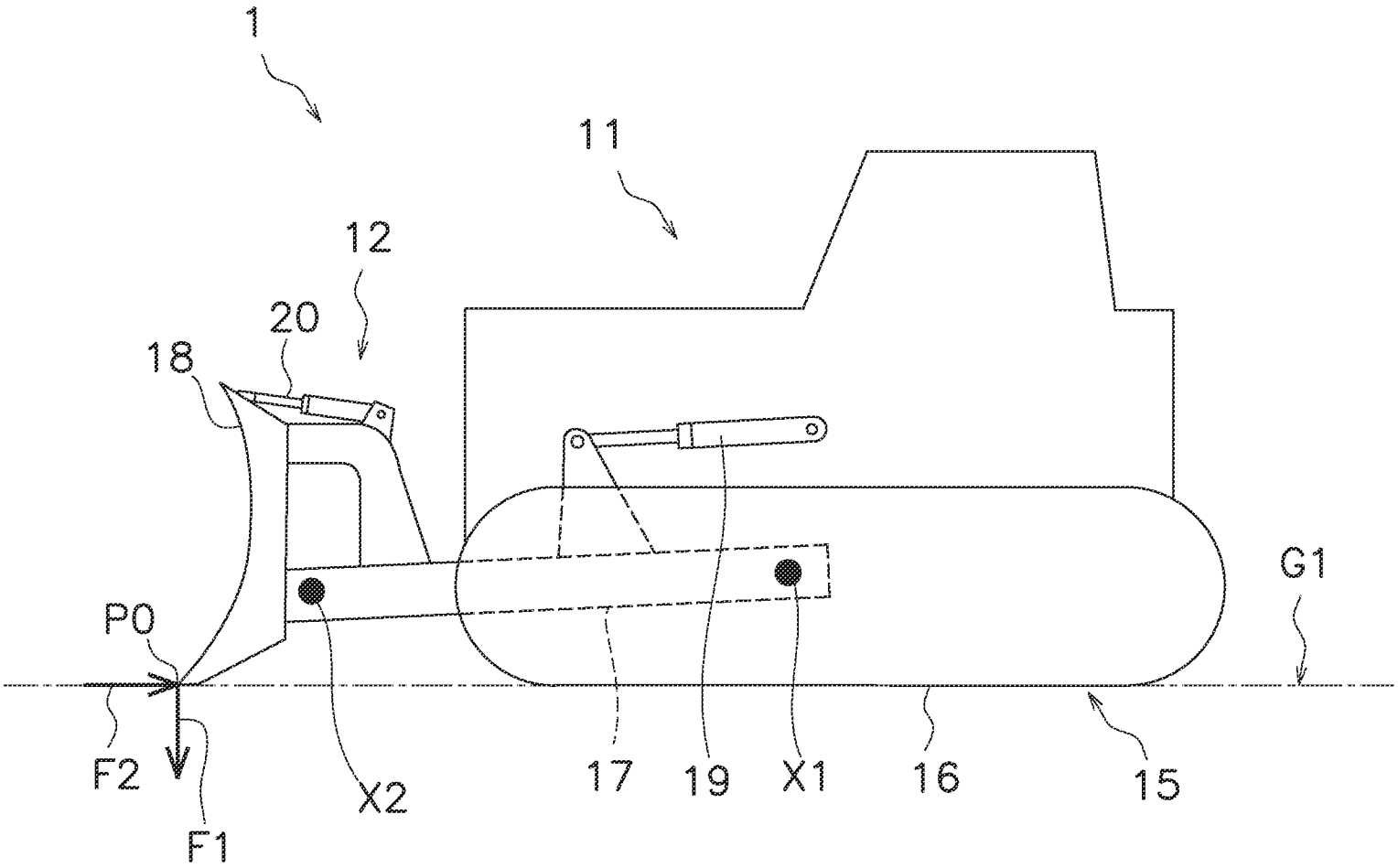
FIG. 5 is a schematic view illustrating a load applied to the blade.
Figure 6:
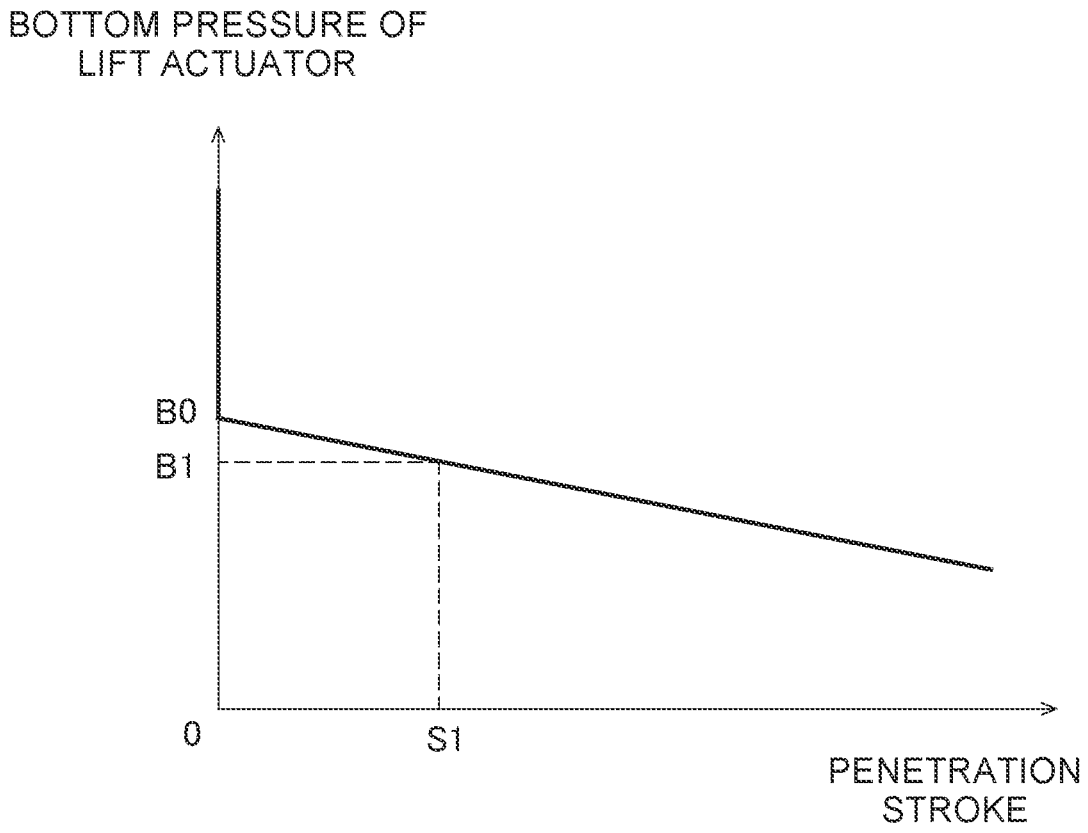
FIG. 6 is a graph illustrating a relation between bottom pressure of a lift actuator and a penetration stroke.

FIG. 5 is a schematic view illustrating a load applied to the blade 18. As illustrated in FIG. 5, the blade tip P0 of the blade 18 is pressed against the ground contact surface G1 with a penetration force F1 in a downward direction due to the bottom pressure of the lift actuator 19 to penetrate the ground. As illustrated in FIG. 6, the bottom pressure of the lift actuator 19 varies according to this penetration stroke. That is, the bottom pressure of the lift actuator 19 relates to the penetration stroke of the blade tip P0 of the blade 18. The bottom pressure of the lift actuator 19 increases as the penetration stroke decreases. The first threshold is determined based on a value of bottom pressure B0 when the front wheels 41 are lifted up. In FIG. 6, B1 indicates the first threshold. Si indicates the penetration stroke when the bottom pressure of the lift actuator 19 is the first threshold B1. As illustrated in FIG. 6, the first threshold B1 is smaller than the bottom pressure B0 when the front wheels 41 are lifted up.

The second condition indicates that the work machine 1 is not performing a digging operation. As illustrated in FIG. 5, the blade tip P0 of the blade 18 receives a load F2 in the horizontal direction. This load F2 in the horizontal direction increases while the work machine 1 is performing the digging operation. The second threshold is determined to be a small value to a degree that assumes that the work machine 1 is not performing the digging operation.

Figure 7:
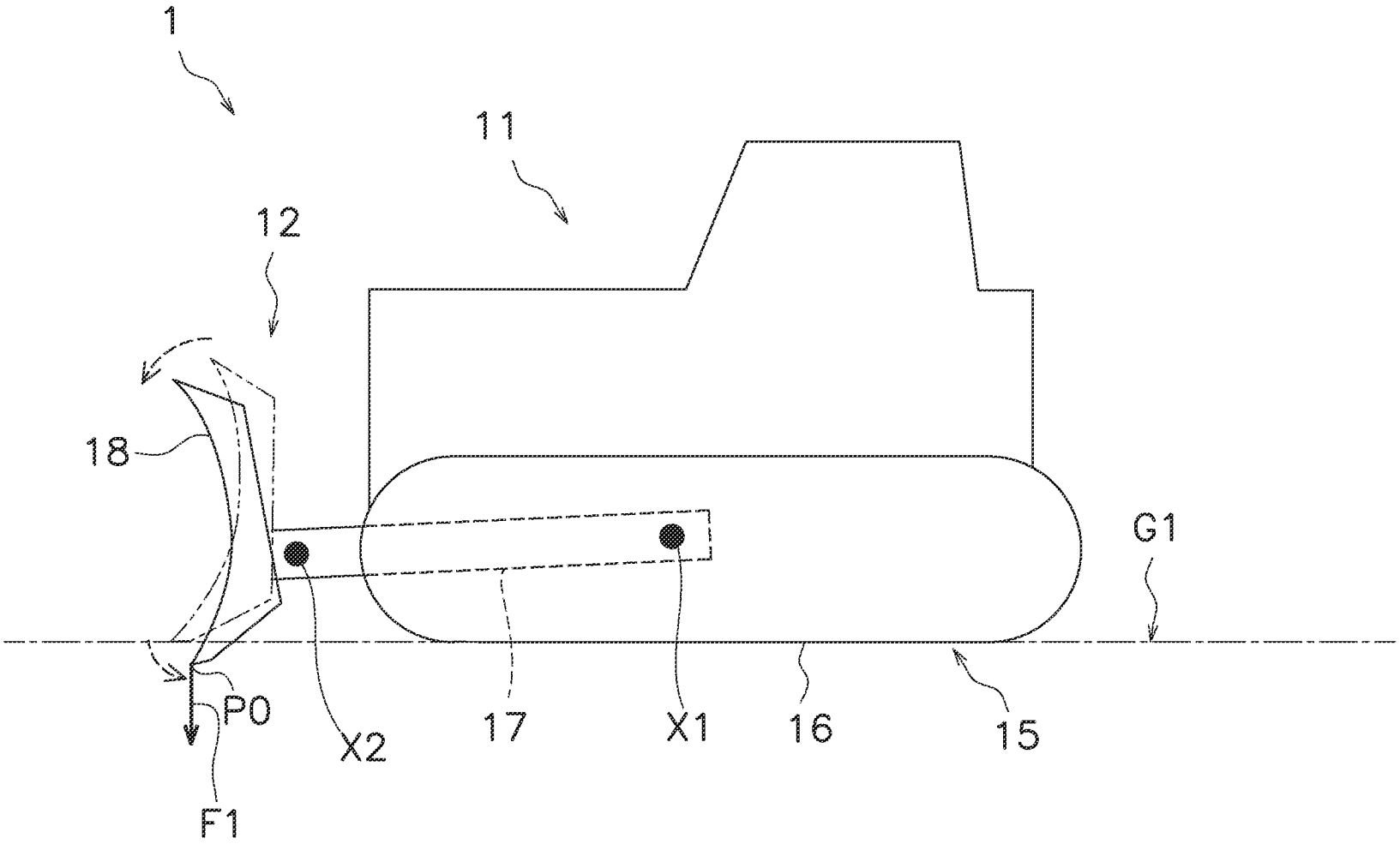
FIG. 7 is a view illustrating a pitch motion under automatic control.

The controller 26 executes the automatic control of the pitch angle when both the first condition and the second condition are satisfied. The controller 26 increases the pitch angle when both the first condition and the second condition are satisfied. That is, as illustrated in FIG. 7, the controller 26 changes the pitch angle so that the blade 18 is tilted forward when both the first condition and the second condition are satisfied. As a result, the penetration force F1 in the downward direction increases, thereby preventing the front wheels 41 from being lifted up.

Figure 8:
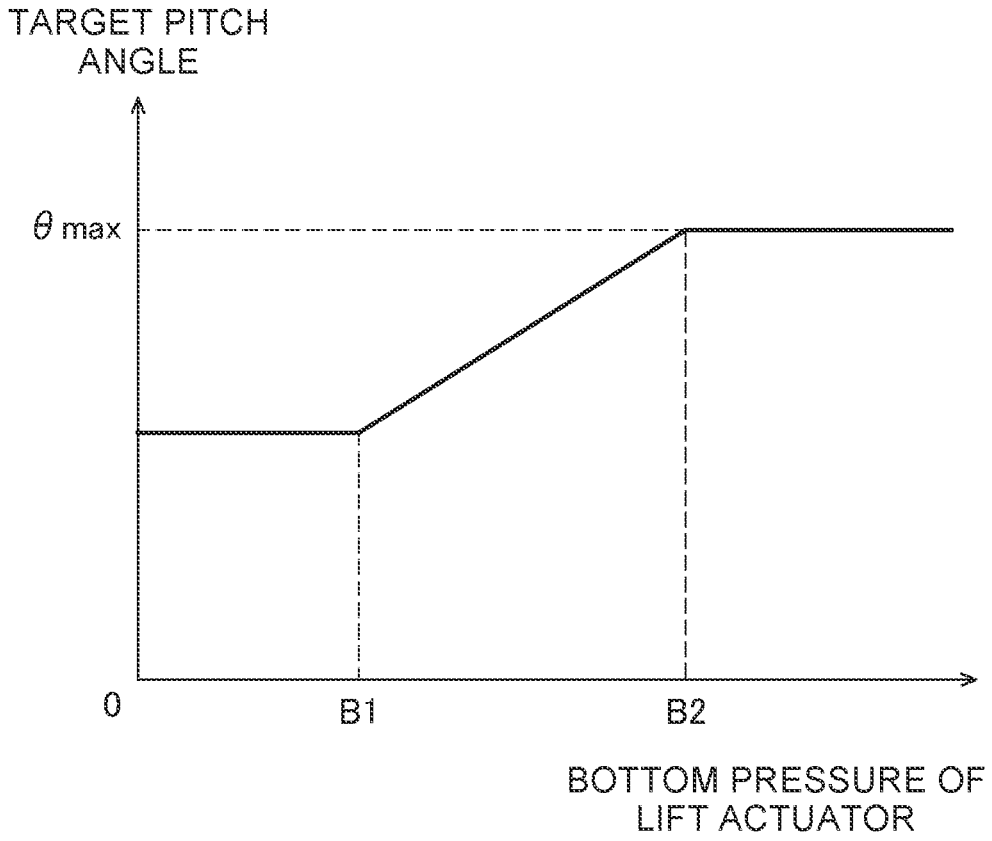
FIG. 8 is a graph illustrating an example of pitch angle data.

The controller 26 stores pitch angle data. The pitch angle data defines the relation between the bottom pressure of the lift actuator 19 and a target pitch angle. The controller 26 refers to the pitch angle data to determine the target pitch angle from the bottom pressure of the lift actuator 19 under the automatic control. The controller 26 controls the pitch actuator 20 so that the pitch angle of the blade 18 is the target pitch angle. FIG. 8 is a graph illustrating an example of the pitch angle data.

In FIG. 8, a threshold B1 is the above-mentioned first threshold. The controller 26 increases the target pitch angle when the bottom pressure of the lift actuator 19 is greater than or equal to the first threshold B1. As a result, the blade 18 is tilted forward. The controller 26 increases the target pitch angle in a range from the first threshold B1 to a third threshold B2 of the bottom pressure of the lift actuator 19 as the bottom pressure of the lift actuator 19 increases. When the bottom pressure of the lift actuator 19 is greater than or equal to the third threshold B2, the target pitch angle is constant at a maximum pitch angle θmax.

In the manual mode, the controller 26 controls the pitch actuator 20 so as to change the pitch angle of the blade 18 according to the operation of the operating device 31. Also, when the operating device 31 is not operated, the controller 26 controls the pitch actuator 20 so as to maintain the pitch angle of the blade 18. For example, when the operating device 31 is not operated, the controller 26 controls the pitch actuator 20 so as to maintain the pitch angle of the blade 18 even if there is a leakage of the hydraulic fluid at the control valve 27.

The work machine 1 according to the present embodiment described above determines whether the penetration force F1 is insufficient based on the bottom pressure of the lift actuator 19. The bottom pressure of the lift actuator 19 relates to the penetration force F1 of the blade tip P0 of the blade 18 in the downward direction. Upon determining that the penetration force F1 is insufficient, the controller 26 causes the blade 18 to perform the pitch motion in the forward tilt direction. As a result, the penetration force F1 increases, thereby preventing the front wheels 41 from being lifted up. As described above, in the work machine 1 according to the present embodiment, the pitch angle of the blade 18 can be easily and appropriately adjusted according to the work load.

Although one embodiment of the present invention has been described above, the present invention is not limited to the above-mentioned embodiment and various modifications can be made without departing from the gist of the invention.

The work machine 1 is not limited to a bulldozer and may be another vehicle such as a wheel loader, a motor grader, or the like. The controller 26 may have a plurality of controllers separate from each other. The processes by the controller 26 are not limited to those of the above-mentioned embodiment and may be changed. A portion of the processes in the automatic mode or the manual mode described above may be omitted. Alternatively, a portion of the processes described above may be changed.

The lift actuator 19 and the pitch actuator 20 are not limited to hydraulic cylinders. The lift actuator 19 and the pitch actuator 20 may be another actuator such as an electric motor, for example.

The first parameter is not limited to the bottom pressure of the lift actuator 19. The first parameter may be one or more parameters such as the pitch angle of the lift frame, or a combination thereof. The second parameter is not limited to the head pressure of pitch actuator 20. The second parameter may be one or more parameter such as the pitch angle of the blade 18, or a combination thereof.

According to the present disclosure, the pitch angle of the blade can be easily and appropriately adjusted in the work machine according to the work load.

The invention claimed is:

1. A work machine comprising:

a vehicle body including a front wheel, a rear wheel, and a crawler belt wound around the front wheel and the rear wheel;

a blade supported so as to be rotatable about a pitch axis with respect to the vehicle body;

a pitch actuator connected to the blade, the pitch actuator being configured to cause the blade to perform a pitch motion about the pitch axis in a forward tilt direction and a backward tilt direction;

a first sensor configured to detect a first parameter relating to a penetration force of a blade tip of the blade in a downward direction; and a controller configured to determine whether the penetration force is insufficient based on the first parameter by determining whether the first parameter is greater than or equal to a first threshold, and control the pitch actuator to increase a pitch angle of the blade in the forward tilt direction according to an increase of the first parameter upon determining that the first parameter is greater than or equal to a first threshold, the first threshold being determined based on a value of the first parameter when the front wheel is lifted up.

2. The work machine according to claim 1, further comprising:

a lift frame supported so as to be rotatable about a lift axis with respect to the vehicle body; and a lift actuator connected to the lift frame and the vehicle body, the lift actuator being configured to cause the lift frame to perform a lift motion up and down about the lift axis, the lift actuator being a hydraulic cylinder, and the first parameter being a bottom pressure of the lift actuator.

3. The work machine according to claim 1, wherein the controller is configured to determine a digging state of the work machine, and cause the blade to perform the pitch motion in the forward tilt direction according to the digging state.

4. The work machine according to claim 3, further comprising:

a second sensor configured to detect a second parameter relating to a load applied to the blade tip of the blade in a horizontal direction, the controller being configured to determine the digging state based on the second parameter.

5. The work machine according to claim 4, wherein the pitch actuator is a hydraulic cylinder, and the second parameter is a head pressure of the pitch actuator.

6. A method for controlling a work machine including a vehicle body that has a front wheel, a rear wheel, and a crawler belt wound around the front wheel and the rear wheel, a blade supported so as to be rotatable about a pitch axis with respect to the vehicle body, and a pitch actuator connected to the blade, the pitch actuator being configured to cause the blade to perform a pitch motion about the pitch axis in a forward tilt direction and a backward tilt direction, the method for controlling the work machine comprising:

detecting a first parameter relating to a penetration force of a blade tip of the blade in a downward direction;

determining whether the penetration force is insufficient based on the first parameter by determining whether the first parameter is greater than or equal to a first threshold; and controlling the pitch actuator to increase a pitch angle of the blade in the forward tilt direction according to an increase of the first parameter upon determining that the first parameter is greater than or equal to a first threshold; and the first threshold being determined based on a value of the first parameter when the front wheel is lifted up.

7. The method according to claim 6, wherein the work machine further includes a lift frame supported so as to be rotatable about a lift axis with respect to the vehicle body, and a lift actuator connected to the lift frame and the vehicle body, the lift actuator is configured to cause the lift frame to perform a lift motion up and down about the lift axis, the lift actuator is a hydraulic cylinder, and the first parameter is a bottom pressure of the lift actuator.

8. The method according to claim 6, further comprising:

determining a digging state of the work machine; and causing the blade to perform the pitch motion in the forward tilt direction according to the digging state.

9. The method according to claim 8, further comprising:

detecting a second parameter relating to a load applied to the blade tip of the blade in a horizontal direction, the determining the digging state being based on the second parameter.

10. The method according to claim 9, wherein the pitch actuator is a hydraulic cylinder, and the second parameter is a head pressure of the pitch actuator.

* * * * *